United States Patent [19]

Muller

[11] Patent Number: 5,027,717

[45] Date of Patent: Jul. 2, 1991

[54] PASSENGER VEHICLE FOR TRANSPORTATION DEVICE

[75] Inventor: Werner Muller, Bern, Switzerland

[73] Assignee: Von Roll Transportsysteme AG, Thun, Switzerland

[21] Appl. No.: 388,024

[22] Filed: Jul. 31, 1989

[30] Foreign Application Priority Data

Aug. 4, 1988 [CH] Switzerland ..... 956/88

[51] Int. Cl.[5] ..... B61C 13/00

[52] U.S. Cl. ..... 105/422; 105/443; 105/142

[58] Field of Search ..... 105/422, 443, 329.1, 105/149.1, 150, 142, 148, 238.1, 242, 392; 52/29, 30; 104/127, 128, 173.1

[56] References Cited

U.S. PATENT DOCUMENTS 262,643 8/1882 Collins ..... 104/128
4,516,519 5/1985 Gulick ..... 114/39.1

FOREIGN PATENT DOCUMENTS 896052 4/1952 Fed. Rep. of Germany ..... 105/397
896052 11/1953 Fed. Rep. of Germany .

OTHER PUBLICATIONS

General Editor O. S. Nock, Encyclopedia of Railways, "Mountain Railways", pp. 316–317, 1977 Octapus Book Ltd.

*Primary Examiner*—Joseph F. Peters, Jr.
*Assistant Examiner*—Virna Lissi Majica
*Attorney, Agent, or Firm*—Cushman, Darby & Cushman

[57] ABSTRACT

Apparatus for assisting passengers in standing within a car of a funicular is described which has shallow footing troughs with convexly shaped floor sections joining the troughs. The floor thus formed does not have any sharp angled shoulders so as to protect the passengers from injury if one should fall. The likelihood of such an accident occurring is less due to the absence of such shoulders as passengers have sounder footing. Bumps or strips can also be provided for safer footing.

8 Claims, 3 Drawing Sheets

PASSENGER VEHICLE FOR TRANSPORTATION DEVICE

FIELD OF THE INVENTION

The invention relates to a passenger vehicle for a transportation device where the line is inclined at least over the major part of its length and is defined by guide elements.

BACKGROUND OF THE INVENTION

In connection with cars of funiculars it is known to design the floor of the passenger cabin in the form of stairsteps. The steps of the stairs are disposed in such a way that the angle enclosed by their treads together with the longitudinal axis of the vehicle approximately correspond to the average inclination angle of the line. This design has the purpose of permitting the passengers to stand on supports which are horizontal or enclose as small an angle as possible with respect to the horizontal line.

A basic disadvantage of this design of the inside of the cabin lies in that the stair steps constitute obstacles for the traffic in the passenger cabin, for example during entering and leaving as well as during movement inside the cabin to accommodate additional persons. These obstacles are hardly visible, particularly when the passenger cabin is full, which causes a danger of tripping or falling which can easily lead to accidents.

If the passenger cabin has been divided into compartments in a known manner and the length of the treads corresponds to the length of the compartments, the stairsteps are no longer obstacles. The individual compartments then have a level floor.

Even when the danger of tripping has been eliminated in the above manner, the known design does not fulfill the requirements made today for the comfort of the passengers. As a rule, it is not possible to maintain the inclination of the line constant and thus to offer a safe and comfortable place to stand for the passengers over the entire length of the line. The subdivision into compartments, the length of which corresponds to that of the stairsteps, also requires, besides the separating walls, a corresponding number of doors and closing mechanisms therefor, which increases the price of the vehicle as well as the cost for maintenance.

SUMMARY OF THE INVENTION

It is an object of the invention to provide footing for passengers in a cost-effective manner which makes possible a comfortable adaptation to the balance situation even when the inclination of the line is changed momentarily. This object is attained by means of the steps which are formed by shallow footing troughs which are connected without shoulders.

Because the footing troughs follow each other without shoulders, it is possible to walk on the floor of the passenger cabin with considerably lessened danger of tripping; obstacles extending crosswise to the longitudinal direction no longer exist. During the ride the passengers can stand facing one of the side walls of the vehicle and can find a place for their shoes in one or several footing troughs. Because seen in profile, adjoining parts of surface of the footing troughs have different inclination angles, it is easily possible by means of small lateral displacements of one or both feet to maintain the balance even during those inclination changes in the course of the line which are not easily compensated for by an increase in the load of one leg. It is also possible to prevent in this way slipping of the boots.

Preferably the pitch of the floor is selected in such a way that while walking, even children can use the footing troughs as stair steps, i.e., can go from footing trough to footing trough with a single step.

Basically the footing trough pitch of the floor of the passenger cabin should be chosen in a way which permits a person of average body size to place either both feet into the same footing trough or at approximately the same places of the trough sections of two immediately adjacent footing troughs while in a position where both feet are slightly spread, i.e., at a distance of the feet of about 300 mm.

It has been shown that with a steady radius of curvature of between 0.8 to two times the pitch, comfortable standing and easy correction of the balance is possible.

The footing troughs are preferably connected with each other by means of convexly bent floor sections. This configuration results in further reduction of the danger of tripping while walking in the passenger cabin, because there are no ridged connections between the footing troughs. Furthermore, it is also possible to stand at least on parts of these convexly bent floor sections if a suitable radius of curvature is selected, which leads to an increase in the number of possible places to stand in a passenger cabin with a given floor space.

Below, two exemplary embodiments of the passenger vehicle of the invention in connection with a funicular are described in detail by means of the drawings.

DETAILED DESCRIPTION OF THE PREFERRED EMBODIMENTS

Figure 1:
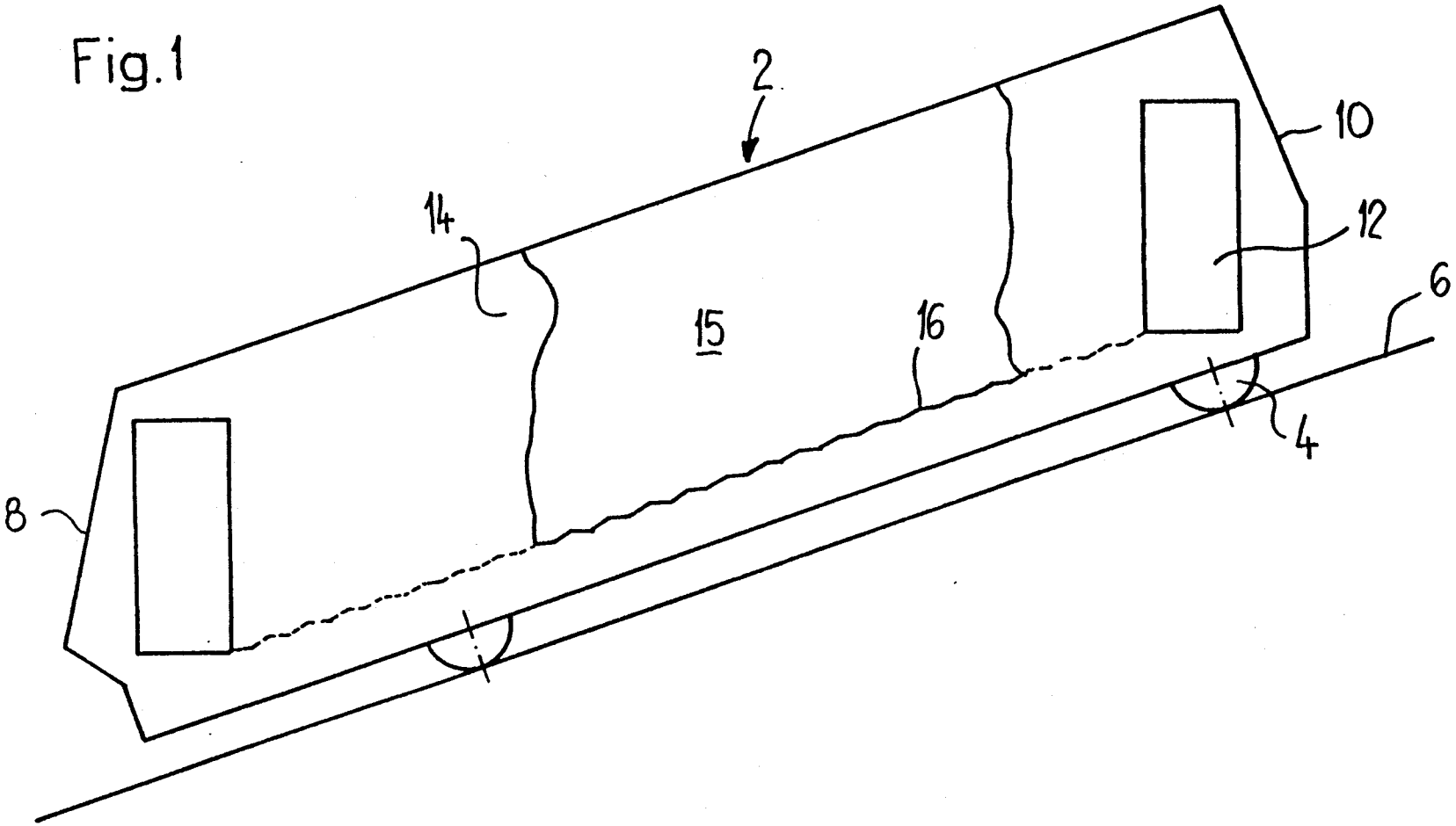
FIG. 1 is a schematic lateral view of a funicular car having a passenger cabin floor with footing troughs.

As shown in FIG. 1, a car of a funicular 2 is guided by means of wheels 4 on an inclined line formed by tracks 6, on which it is moved by a pull cable, not shown. On both ends 8 and 10 the car 2 has doors 12 which are provided in its side walls 14 and permit entry into a passenger cabin 15. The passenger cabin 15 has a floor 16, the stair-like design of which is shown in more detail in FIGS. 2 and 3.

In accordance with the invention the stair-like floor 16, 16' has footing troughs 20, 20' which follow each other without shoulders. In the exemplary embodiments shown, each footing trough 20, 20' has a constant radius of curvature 22, 22' and follows another with a pitch of 24, 24'. Convexly bent floor sections 26, 26' with a radius of curvature 28, 28' connect the footing troughs 20, 20' with each other without shoulders. As can be further seen from FIGS. 2 and 3, flat bumps or strips 30, 30', made of a material which prevents slipping even when wet, have been provided on the floor 16, 16' and extend transversly to the longitudinal direction of the passenger cabin 15. The floor 16, 16' itself may be provided with such a covering (not shown) which itself has the bumps. Instead of the flat bumps the floor may also be equipped with ribbing and grooves which, for example, run parallel to the direction of the footing troughs, i.e., transversly of the longitudinal direction of car 2.

Figure 2:
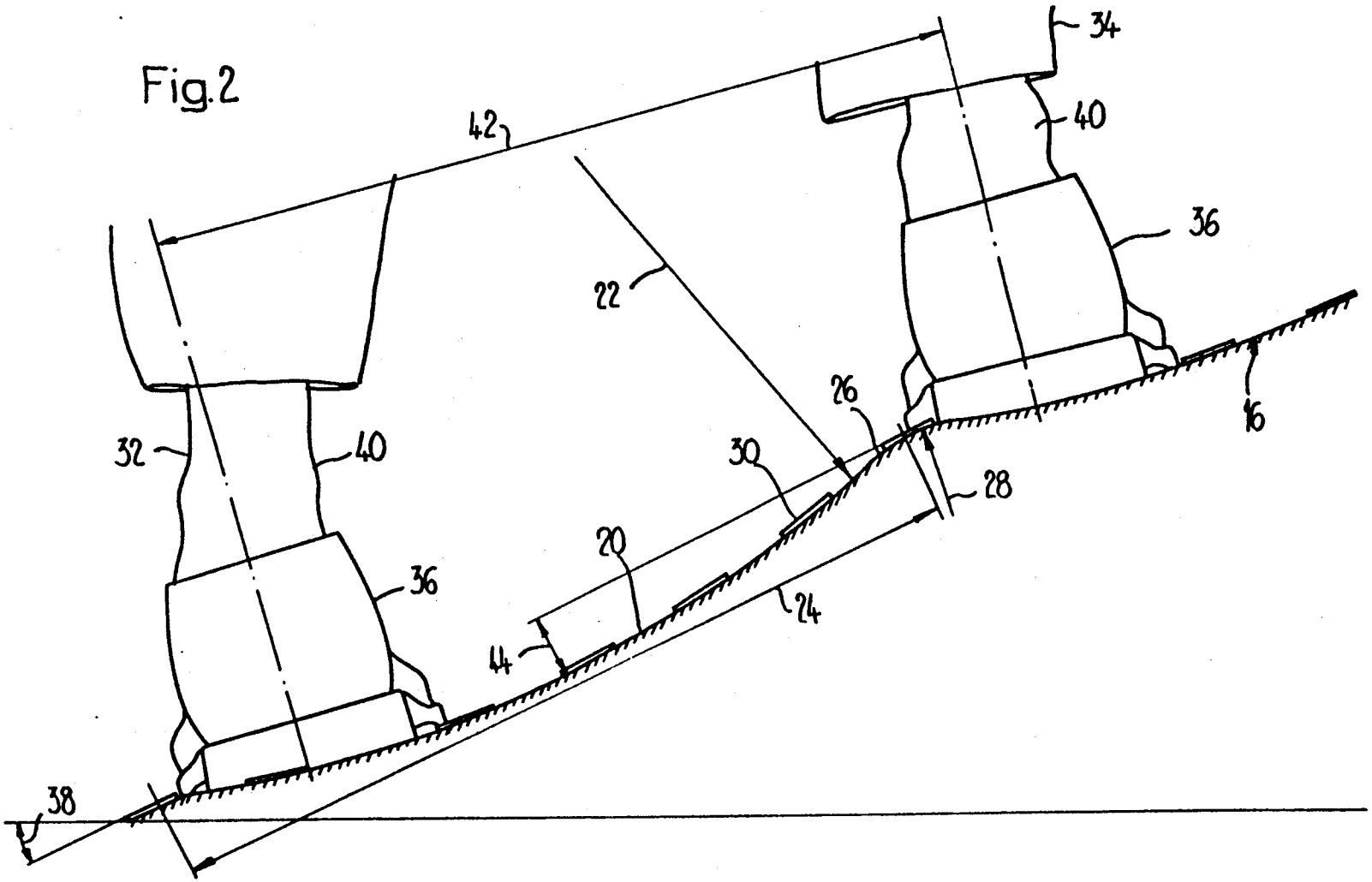
FIG. 2 is a longitudinal section of an exemplary embodiment of the floor, showing the footing troughs in enlarged scale and with an exemplary standing position at a given inclination at that moment.
Figure 3:
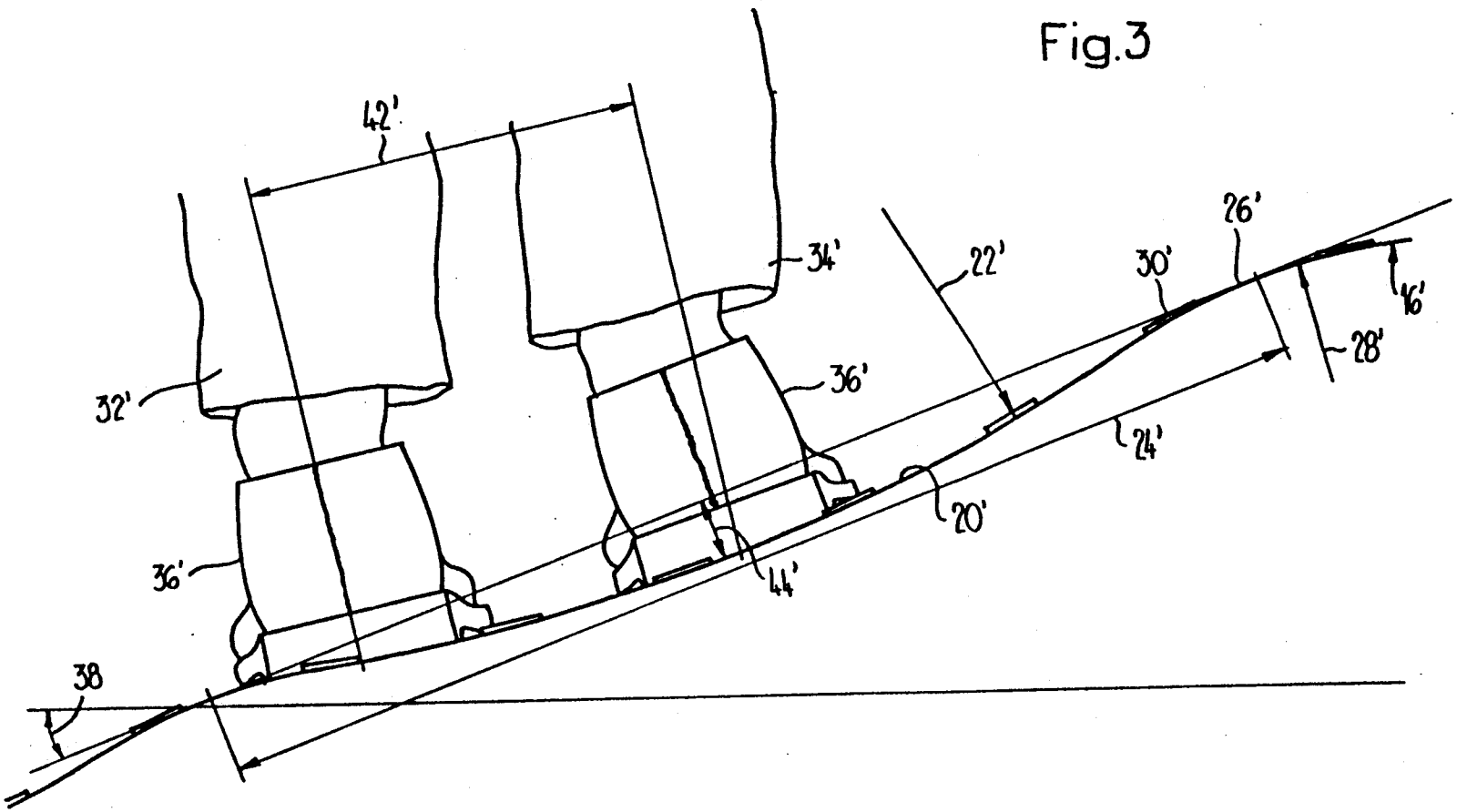
FIG. 3 is a second embodiment in an illustration corresponding to FIG. 2.

The exemplary embodiments shown in FIGS. 2 and 3 differ from each other in that the pitch 24' according to FIG. 3 is greater than the pitch 24 according to FIG. 2. Accordingly, in FIG. 2 the standing position of a passenger is indicated by two legs 32 and 34, the feet 36 of which are positioned in two immediately adjacent footing troughs 20. The feet 36 are in approximately the same relative locations within the sections of the two footing troughs 20. In a person of average size, the position of the feet 36 corresponds to a slight spread of the feet and is aligned approximately parallel to the direction of the footing troughs. This corresponds to a normal position, facing one of the side walls, of the passengers during travel.

A bending of the ankles 40, as represented in FIG. 2, corresponds to the approximately greatest inclination of the line as indicated by angle 38. This bending makes it possible to maintain the center of gravity of the body within the base determined by the distance 42 of the feet and thus to maintain a stable balance. Obviously this balance can be maintained with a lesser bending at the ankles or without such bending if the inclination is less than that shown. If desired, one or both feet 36 can be placed further from the section 26 for this purpose. In the exemplary embodiment according to FIG. 2 the pitch 24 is about 300 mm. However, when using two footing troughs, pitches between 250 mm and 400 mm are also conceivable without making it necessary to assume uncomfortable positions in regard to the foot distance 42 as well as in regard to the bending of the ankles 40. The radius of curvature 22 is approximately 450 mm in the embodiment according to FIG. 2.

In general, the choice of this radius of curvature is governed by the pitch 24 in the sense that it is intended to provide, by means of the tilt of the trough section which is opposite to the inclination, positions for the feet which permit an approximation to the horizontal position, correctable by easy bending at the ankles 40. Therefore the profile of the trough section is also dependent on the amount of change of the inclination of the line. In the exemplary embodiment shown it has been assumed that the change in inclination comes to 30% and the maximum inclination of the line is near 50% corresponding to the angle 38. Because of the increase in the danger of tripping, much greater trough depths than the one in this exemplary embodiment and designated with 44 should be avoided. A comparatively small radius 28 of from 30 mm to 50 mm is sufficient for the convex curvature of the floor section 26. In the exemplary embodiment in accordance with FIG. 3, which has been based on the same line section as the one assumed in connection with FIG. 2, the pitch 24' is approximately 500 mm and the feet 36' of a passenger have been positioned at a distance 42' of about 320 mm in a single footing trough 20', as illustrated. Although the entire body weight practically rests on the leg 32' during the greatest inclination, a slight bracing above the leg 34' is possible in order to take up a secure standing position. With the assumed changes in inclination of the line, correction of the balance is possible by shifting of the weight alone, without it being absolutely required to change the position of the feet 36'. The radius of curvature 22' is of the same magnitude as the pitch 24', while the radius 28' is about 40 mm.

For reasons of completeness it should be mentioned that the footing troughs or stair steps are not absolutely required to be at right angles to the longitudinal extent of the car 2 or its side walls. In particular, it is also possible that they extend at an angle diverging by 2° to 5° from a right angle. On the other hand it is also conceivable to impart to the stair steps or footing troughs a slightly bent course.

While in the exemplary embodiment shown the car floor 16 in general extends parallel to the tracks 6, it is also possible to have it form an acute angle with the tracks. This acute angle, which partially compensates for the inclination of the line, can be selected in such a way that the car floor 16 extends approximately level during the smallest inclination of the line.

Even with a different orientation of the feet in regard to the direction of extent of the footing troughs from the parallel one shown, the footing troughs according to the invention also offer to the passengers advantageous standing possibilities.

What is claimed is:

1. A passenger vehicle for a transporting device with a longitudinal transport axis for use on a line which is predominantly inclined and is defined by guide elements, in particular for cars for a funicular, said vehicle comprising:

a passenger cabin floor which is stair-like in a longitudinal direction and which has a plurality of steps including a plurality of concavely curved footing troughs transversely disposed with respect to said transport axis connected with each other in a manner such that there are no dividing edges between adjacent troughs.

2. A passenger vehicle in accordance with claim 1, wherein the floor is provided with flat strips, said strips being disposed at least in the footing troughs.

3. A passenger vehicle in accordance with claim 1, further comprising convexly curved shoulderless floor sections which connect the footing troughs.

4. A passenger vehicle in accordance with claim 1, wherein each of said plurality of footing troughs is formed in a smooth continuous manner and has a constant radius in its profile, and wherein the footing troughs are disposed so as to follow each other with a pitch which is in a range of from 250 mm to 550 mm.

5. A passenger vehicle in accordance with claim 4, further comprising convexly curved shoulderless floor sections which connect the footing troughs.

6. A passenger vehicle in accordance with claim 4, wherein the radius of curvature of each footing trough is in a range from 0.8 to two times the pitch.

7. A passenger vehicle in accordance with claim 6, further comprising convexly curved shoulderless floor sections which connect the footing troughs.

8. A passenger vehicle in accordance with claim 1 wherein each trough has a pitch in the range of from 250 mm to 550 mm.

* * * * *